US005702657A

United States Patent [19]

Yoshida et al.

[11] Patent Number: 5,702,657

[45] Date of Patent: Dec. 30, 1997

[54] METHOD FOR THE CONTINUOUS PRODUCTION OF A POLYETHYLENE MATERIAL HAVING HIGH STRENGTH AND HIGH MODULUS OF ELASTICITY

[75] Inventors: Sumio Yoshida; Takashi Komazawa, both of Yokohama; Kazuhiko Kurihara, Tokyo; Hiroshi Yazawa, Kunitachi, all of Japan

[73] Assignees: Nippon Oil Co., Ltd.; Polymer Processing Research Institute Ltd., both of Tokyo, Japan

[21] Appl. No.: 578,433

[22] Filed: Dec. 26, 1995

[30] Foreign Application Priority Data

Dec. 27, 1994 [JP] Japan ..... 6-324309

[51] Int. Cl.[6] ..... B29C 43/24; B29C 55/18

[52] U.S. Cl. ..... 264/112; 264/119; 264/126; 264/147; 264/211

[58] Field of Search ..... 156/324, 242, 156/243, 246, 148; 264/211, 103, 113, 126, 147, 112, 119

[56] References Cited

U.S. PATENT DOCUMENTS

| | | | |
|---|---|---|---|
| 5,091,133 | 2/1992 | Kobayashi | 264/126 |
| 5,106,555 | 4/1992 | Kobayashi | 264/126 |
| 5,106,558 | 4/1992 | Kobayashi | 254/126 |
| 5,200,129 | 4/1993 | Kobayashi | 264/126 |
| 5,578,373 | 11/1996 | Kobayashi | 264/126 |

FOREIGN PATENT DOCUMENTS

| | | |
|---|---|---|
| 0 244 486 | 11/1987 | European Pat. Off. . |
| 0 483 780 | 5/1992 | European Pat. Off. . |

OTHER PUBLICATIONS

Kirk–Othmer Encyclopedia of Chemical Techology, 4th Ed., vol. 10, John Wiley & Sons, Inc. (1993) pp. 761–787.

*Primary Examiner*—Daniel Stemmer

*Attorney, Agent, or Firm*—Oblon, Spivak, McClelland, Maier & Neustadt, P.C.

[57] ABSTRACT

Disclosed is a method for the continuous production of a polyethylene material having high strength and high modulus of elasticity by rolling an ultra-high-molecular-weight polyethylene film or film like material and then drawing the rolled material, wherein a thermoplastic resin film having incorporated therein at least one additive selected from the group consisting of a coloring agent, a weathering stabilizer, an antistatic agent, a hydrophilicity-imparting agent, an adhesion promoter and a dyeability-imparting agent is laminated to the film material in the rolling step and the resulting polyethylene material is further slit or split as required. This method makes it easy to color the polyethylene material having high strength and high modulus of elasticity and to impart weather resistance and other desirable properties thereto.

25 Claims, 4 Drawing Sheets

METHOD FOR THE CONTINUOUS PRODUCTION OF A POLYETHYLENE MATERIAL HAVING HIGH STRENGTH AND HIGH MODULUS OF ELASTICITY

BACKGROUND OF THE INVENTION a) Field of the Invention

This invention relates to a method for the continuous production of a surface-modified polyethylene material having high strength and high modulus of elasticity. More particularly, it relates to a method for the continuous production of a polyethylene material suitable for the formation of ultra-high-molecular-weight polyethylene tape yarn and split yarn having high strength and high modulus of elasticity.

b) Description of the Prior Art

The so-called ultra-high-molecular-weight polyolefins having significantly high molecular weights are excellent in impact resistance and wear resistance and, moreover, have self-lubricating properties. Consequently, they are used as unique engineering plastics in various fields of application. These ultra-high-molecular-weight polyolefins have much higher molecular weights than general-purpose polyolefins. Accordingly, it is expected that, if a highly oriented material of such an ultra-high-molecular-weight polyolefin can be stably formed into slit yarn or split yarn and if such products can be efficiently colored or endowed with light resistance or antistatic properties, they will find a wide range of new applications including, for example, ropes and nets having high strength and high modulus of elasticity and useful for outdoor industrial purposes, as well as sporting goods and leisure goods.

However, ultra-high-molecular-weight polyethylene has a higher melt viscosity than general-purpose polyethylene. In the present situation, therefore, ultra-high-molecular-weight polyethylene has significantly poor formability and cannot be highly oriented by drawing in a state containing an additive or additives.

By way of example, in order to color polyolefin fibers which are highly hydrophobic and have no dyeing seat, Japanese Patent Laid-Open No. 168980/'89 practically employs mass-coloring with a pigment or blending with a metallic salt which is used as a seat for dyeing with a specific dye. Thus, this patent provides a dyeing method using a specific dye, but demonstrates that no high-strength polyolefin fiber can be obtained.

For similar purposes, Japanese Patent Laid-Open No. 227464/'91 provides a dyeing method using a specific dye having a certain ratio of inorganic to organic quality. Moreover, Japanese Patent Laid-Open No. 289213/'92 provides a method for the production of an ultra-high-molecular-weight polyethylene fiber having high strength and high modulus of elasticity wherein, after spinning, a solvent-containing gel-like fiber is doped with a dye and then drawn.

Furthermore, Japanese Patent Laid-Open No. 77232/'92 provides a method which comprises compression-molding a mixture of an ultra-high-molecular-weight polyethylene and a dye and/or a pigment at a temperature lower than the melting point of the polyethylene and then drawing the compression-molded material.

In addition, Japanese Patent Laid-Open No. 122746/'92 provides a method for the production of a polyethylene material having modified surface properties (i.e., improved adhesion properties) by subjecting a principal component comprising an ultra-high-molecular-weight polyethylene and a component containing polyvinyl chloride to at least a drawing step at a temperature lower than the melting point of the polyethylene. In this patent, it is also disclosed that an ultra-high-molecular-weight polyethylene in powder form is compression-molded on endless belts and the resulting material is then rolled and drawn.

On the other hand, Japanese Patent Laid-Open No. 130116/'91 discloses a method for the continuous production of a polyethylene material having high strength and high modulus of elasticity by compression-molding an ultra-high-molecular-weight polyethylene powder and then rolling and drawing the resulting material. According to this method, in the compression molding step and/or the rolling step, an olefin polymer (e.g., polyethylene) having a lower molecular weight than the ultra-high-molecular-weight polyethylene powder and taking the form of powder, rods, fibers, sheet, film or nonwoven fabric is allowed to coexist in admixture or combination with the ultra-high-molecular-weight polyethylene, so that its lamination to or assembly with laminates or other materials is facilitated.

Moreover, as disclosed in Japanese Patent Laid-Open No. 214657/'93, it is known that a drawn and split polyethylene material formed by drawing an ultra-high-molecular-weight polyethylene and then splitting the drawn material is suitable for use, for example, as ropes for sporting or leisure use.

However, the methods of the aforementioned Japanese Patent Laid-Open Nos. 168980/'89 and 227464/'91 require a special dyeing material and cannot meet a wide range of requirements, the method of Japanese Patent Laid-Open No. 77232/'92 fails to achieve the easy and stable production of a polyethylene material having high strength and high modulus of elasticity, and the method of Japanese Patent Laid-Open No. 122746/'92 involves the formation of a mixture and hence causes a marked reduction in the characteristics inherent in a polyethylene material having high strength and high modulus of elasticity. Although the method of Japanese Patent Laid-Open No. 130116/'91 can solve the problems to some degree, the characteristics of the ultra-high-molecular-weight polyethylene material itself need to be exhibited to the fullest extent, and there is a continuing demand for a more multifunctional material suitable for use as slit yarn or split yarn. On the other hand, Japanese Patent Laid-Open No. 214657/'93 discloses a method for splitting a drawn ultra-high-molecular-weight polyethylene material. However, no statement suggesting the effects of the present invention which results from the constitution of the present invention and the employment thereof as will be described later is found therein.

OBJECTS AND SUMMARY OF THE INVENTION

It is an object of the present invention to provide an improved method for the production of a polyethylene material having high strength and high modulus of elasticity, particularly tape yarn or split yarn having consistent characteristics, which makes it possible to meet various requirements easily and improve the colorability, weather resistance, antistatic properties and other characteristics of the product, without impairing the characteristics (i.e., high strength and high modulus of elasticity) inherent in the ultra-high-molecular-weight polyethylene materials obtained by the above-described conventional methods.

Accordingly, the present invention provides a method for the continuous production of a polyethylene material having high strength and high modulus of elasticity by rolling an ultra-high-molecular-weight polyethylene film or film like material (hereinafter referred to a film material) having an intrinsic viscosity of 5 to 50 dl/g as measured in decalin at 135° C. and then drawing the rolled material, characterized in that, in the rolling step, at least one thermoplastic resin layer having incorporated therein at least one additive selected from the group consisting of a coloring agent, a weathering stabilizer, an antistatic agent, a hydrophilicity-imparting agent, an adhesion promoter and a dyeability-imparting agent is laminated to the film material to be rolled.

In the practice of the above-described present invention, a thermoplastic resin film can be used in the rolling step for processing an ultra-high-molecular-weight polyethylene film material obtained by a solid-phase process, a melt-forming process or a gel process.

In the practice of the above-described present invention, the polyethylene material obtained from the drawing step may further be slit to form tape yarn or split yarn and thereby produce a more excellent polyethylene material having high strength and high modulus of elasticity. Such materials are useful as weathering stabilizer and/or coloring agent-loaded materials for industrial use and for sporting or leisure use, such as ropes, golf nets, long-lines, safety nets, 2- to 4-reel sheeting and high-strength tying bands.

Thus, according to the above-described present invention wherein a thermoplastic resin film having incorporated therein at least one additive selected from the group consisting of a coloring agent, a weathering stabilizer, an antistatic agent, a hydrophilicity-imparting agent, an adhesion promoter and a dyeability-imparting agent is laminated to an ultra-high-molecular-weight polyethylene film material in the rolling step, the resulting polyethylene material having high strength and high modulus of elasticity can, for example, be colored easily. Moreover, it is also possible to impart weather resistance, antistatic properties and other characteristics thereto and further impart post-processability such as dyeability thereto.

DETAILED DESCRIPTION OF THE INVENTION

Figure 1:
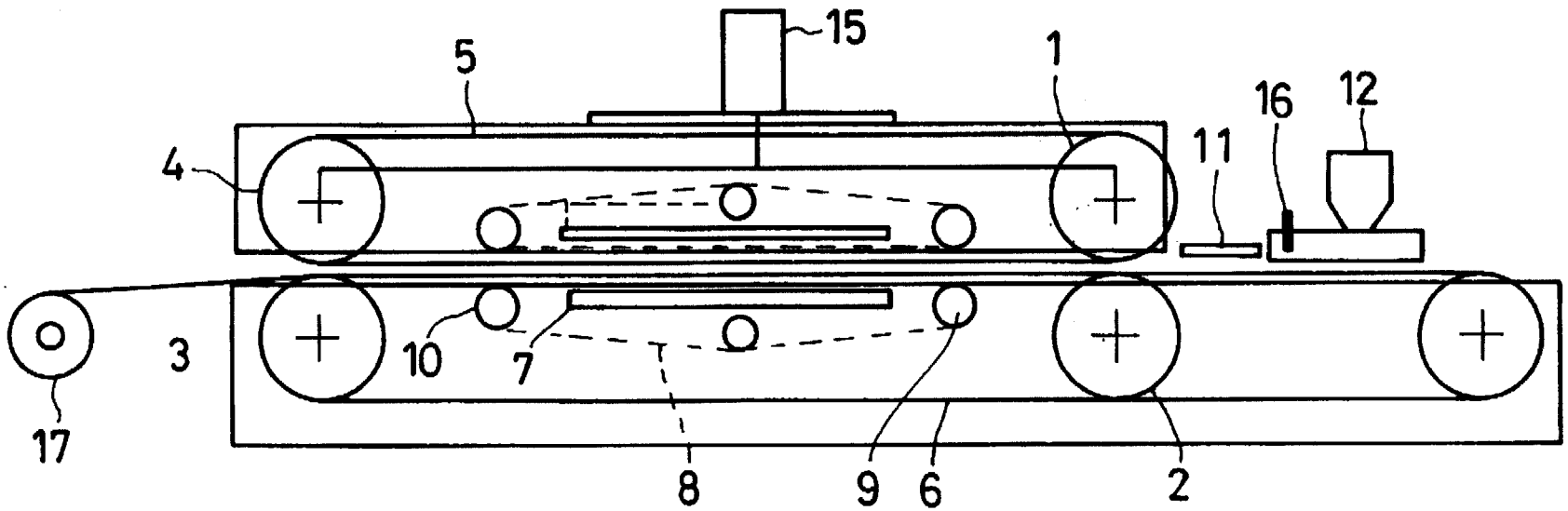
FIG. 1 is a schematic illustration of one exemplary apparatus suitable for carrying out the compression molding step of the present invention.

An ultra-high-molecular-weight polyethylene powder suitable for use in the present invention has an intrinsic viscosity [η] of 5 to 50 dl/g, preferably 8 to 40 dl/g and more preferably 10 to 30 dl/g as measured in decalin at 135° C. and a viscosity-average molecular weight of 500,000 to 12,000,000, preferably 900,000 to 9,000,000 and more preferably 1,200,000 to 6,000,000. If the intrinsic viscosity [η] is less than 5 dl/g, drawn products such as sheet and film have poor mechanical properties. If it is greater than 50 dl/g, workability by tensile drawing or the like becomes undesirably low.

Moreover, an ultra-high-molecular-weight polyethylene powder having a density (in accordance with JIS-K-7112-B method; at temperature of 30° C.) of 0.920 to 0.985, usually 0.920 to 0.980, more usually 0.920 to 0.970 g/cm$^3$ and preferably 0.935 to 0.960 g/cm$^3$ can suitably be used.

The ultra-high-molecular-weight polyethylene having the above-described specific properties and suitable for use in the present invention can be obtained by the homopolymerization of ethylene or the copolymerization of ethylene and an α-olefin in the presence of a catalyst comprising a catalytic component containing at least one compound in which one of the transition metal elements of groups IV to VI of the periodic table is present and, if necessary, an organometallic compound.

For this purpose, α-olefins having 3 to 12 carbon atoms and preferably 3 to 6 carbon atoms can be used. Specific examples thereof include propylene, butene-1, 4-methylpentene-1, hexene-1, octene-1, decene-1and dodecene-1. Among them, propylene, butene-1, 4-methylpentene-1 and hexene-1 are especially preferred. In addition, dienes such as butadiene, 1,4-hexadiene, vinylnorbornene and ethylidenenorbornene may be used as comonomers. The content of the α-olefin in the ethylene-α-olefin copolymer is usually in the range of 0.001 to 10 mole %, preferably 0.01 to 5 mole % and more preferably 0.1 to 1 mole %.

In the preparation of the ultra-high-molecular-weight polyethylene useful in the present invention, a compound containing one of the transition metal elements of groups IV to VI of the periodic table, such as a titanium compound, vanadium compound, chromium compound, zirconium compound or hafnium compound, and, if necessary, an organometallic compound are used in combination as described above. However, the methods for the preparation of such catalytic components are specifically described in the aforementioned Japanese Patent Laid-Open No. 130116/'91 and no description hereof is given herein. Although no particular limitation is placed on the amount of organometallic compound used for this purpose, it is usually used in an amount of 0.1 to 1,000 moles per mole of the transition metal compound.

The polymerization reaction is carried out in a substantially oxygen-free and water-free condition either in a gaseous phase or in the presence of a solvent which is inert to the catalyst or by using the monomer(s) as the solvent. Examples of the inert solvent include aliphatic hydrocarbons such as butane, isobutane, pentane, hexane, octane, decane and dodecane; alicyclic hydrocarbons such as cyclopentane and cyclohexane; aromatic hydrocarbons such as benzene and toluene; and petroleum fractions. The polymerization temperature may usually range from 15 ° to 350° C. and preferably from 20° to 200° C. Where an ultra-high-molecular-weight polyethylene film material is to be formed by a solid-phase process as will be described later, it is desirable that the polymerization temperature be lower than the melting point of the resulting ultra-high-molecular-weight polyethylene. In this case, the polymerization temperature may usually range from −20° to +110° C. and preferably from 0° to 90° C. If the polymerization temperature is not lower than the melting point of the resulting ultra-high-molecular-weight polyethylene, a film material formed by a solid-phase process may not be drawn in a subsequent drawing step at a total draw ratio of 20 or greater. The polymerization pressure may usually range from 0 to 70 $kg/cm^2G$ and preferably from 0 to 60 $kg/cm^2G$.

The molecular weight can be controlled by varying the polymerization temperature, the polymerization pressure, the type of catalyst used, the molar ratio of the catalytic component, the addition of hydrogen to the polymerization system, and the like, and no particular limitation is placed on the manner in which the molecular weight is controlled. Of course, a two-stage or multistage polymerization process in which polymerization conditions such as hydrogen concentration and polymerization are varied can also be carried out without any difficulty.

Although no particular limitation is placed on the form of the ultra-high-molecular-weight polyethylene thus obtained, it is usually preferable to use an ultra-high-molecular-weight polyethylene in granular or powder form. The particle diameter thereof is usually 2,000 μm or less and preferably 1,000 μm or less. Moreover, an ultra-high-molecular-weight polyethylene having a narrower particle size distribution is preferred because it can yield a better sheet.

The resin layer which is laminated in the rolling step and, if necessary, the drawing step of the present method for the continuous production of a polyethylene material having high strength and high modulus of elasticity may comprise a layer of powder, non woven fabrics (contains bundle of fibers), fabrics, or a film. However, a film is preferred. Preferred examples of the thermoplastic resin film include films formed from an olefin polymer (such as ethylene-vinyl acetate copolymer or modified ethylene polymer), a polyamide polymer, a polyester polymer and a polyvinyl chloride polymer. Although no particular limitation is placed on the shape of the film, it usually has a thickness of 10 to 200 μm and preferably 20 to 100 μm.

The olefin polymers which can be used to form preferred thermoplastic resin films are polymers selected arbitrarily from the group consisting of (1) ethylene (co)polymers including ethylene polymer and ethylene-α-olefin copolymers which are prepared by means of a Ziegler catalyst, ethylene polymer and copolymers which are prepared by high-pressure radical polymerization, and mixtures thereof, and (2) modified ethylene (co)polymers obtained by subjecting the foregoing ethylene (co)polymers to graft reaction in the presence of an unsaturated carboxylic acid and/or a derivative thereof, and an organic peroxide. These ethylene (co)polymers have a lower molecular weight than the above-described ultra-high-molecular-weight polyethylene powder and exhibit an intrinsic viscosity [η] of 0.5 to 3 dl/g, preferably 0.8 to 2 dl/g, and a melt index of 0.01 to 100 g/10 min, preferably 0.05 to 100 g/10 min, more preferably 0.1 to 100 g/10 min, preferably 0.5 to 10 g/10 min (as measured at 190° C. under a load of 2.16 g according to ASTM D1238-65T).

In the aforesaid ethylene-α-olefin copolymers prepared by means of a Ziegler catalyst, various α-olefins can be used. Among them, α-olefins having 3 to 12 carbon atoms are preferred, and α-olefins having 3 to 8 carbon atoms are more preferred. Specific examples thereof include propylene, butene-1, pentene-1, 4-methylpentene-1, hexene-1, octene-1, decone-1, dodecene-1 and mixtures thereof. The content of the α-olefin in the ethylene-α-olefin copolymers is usually 20 mole % or less and preferably 15 mole % or less.

The aforesaid ethylene copolymers prepared by high-pressure radical polymerization include, for example, ethylene-vinyl ester copolymers and ethylene-acrylic ester copolymers having a comonomer concentration of not greater than 30% by weight and preferably not greater than 25% by weight. If the comonomer concentration is greater than 30% by weight, the degree of tackiness is increased and compression molding or drawing tends to become difficult.

These ethylene (co)polymer which can be used in the present invention should usually have a density of 0.970 $g/cm^3$ or less, i.e. preferably (ultra) low density polyethylene having a density of 0.935 $g/cm^3$ or less, preferably in a range of 0.930–0.860 $g/cm^2$, most preferably in a range of 0.930–0.910 $g/cm^3$; and medium-high density polyethylene having a density of 0.935 $g/cm^2$ or more, preferably in a range of 0.940–0.970 $g/cm^3$.

These ethylene (co)polymers may suitably be blended with olefin polymers other than those described above, such as homopolymers and interpolymers of ethylene, propylene, butene-1, 4-methylpentene-1, hexene-1 and octene-1, ethylene-propylene copolymer rubber, ethylene-propylene-diene copolymer rubber, polyisobutylene and mixtures thereof, within limits not detracting from the effects of the present invention.

The unsaturated carboxylic acids which can be used to modify the aforesaid ethylene (co)polymer preferably comprise monobasic and dibasic acids, and specific examples thereof include acrylic acid, propionic acid, methacrylic acid, crotonic acid, isocrotonic acid, oleic acid, elaidic acid, maleic acid, fumaric acid, citraconic acid, mesaconic acid and mixtures thereof. The derivatives of unsaturated carboxylic acids which can also be used for the same purpose include metallic salts, amides, esters, anhydrides and other derivatives of the foregoing unsaturated carboxylic acids. Among them, maleic anhydride is most preferred.

Preferred examples of the organic peroxide include benzoyl peroxide, lauryl peroxide, azobisisobutyronitrile, dicumyl peroxide, t-butyl hydroperoxide, α,α'-bis(t-butylperoxydiisopropyl)benzene, di-t-butyl peroxide and 2,5-di(t-butylperoxy)hexyne.

The method for modifying the aforesaid ethylene (co) polymers with an unsaturated carboxylic acid and/or a derivative thereof comprises adding an unsaturated carboxylic acid and/or a derivative thereof to an ethylene (co) polymers and reacting this mixture by heating it in the presence of an organic peroxide. In this method, the unsaturated carboxylic acid and/or derivative thereof are added in an amount of 0.05 to 10% by weight, preferably 0.1 to 7% by weight, based on the ethylene (co)polymer.

The organic peroxide is used in an amount of 0.005 to 2 parts by weight, preferably 0.01 to 1.0 part by weight, per 100 parts by weight of the combination of the ethylene (co)polymer and the unsaturated carboxylic acid. If the amount of organic peroxide used is less than 0.005 part by weight, practically no modifying effect is produced. If it is greater than 2.0 parts by weight, no additional benefit cannot be obtained easily and, moreover, there is a possibility of inducing an excessive degree of decomposition or crosslinking reaction.

The modification reaction can be carried out, for example, by melt-blending the reactants in an extruder or a mixing machine (such as a Banbury mixer) in the absence of solvent, or by heating and mixing the reactants in a solvent selected from aromatic hydrocarbons (such as benzene, xylene and toluene) and aliphatic hydrocarbons (such as hexane,-heptane and octane). Although no particular limitation is placed on the modification method, it is preferable to carry out the modification reaction in an extruder because of its simple operation, good economy and continuity to a subsequent step.

The olefin polymers are preferably used by forming them into a film having a thickness of 10 to 200 μm, preferably 20 to 100 μm, according to any well-known technique.

The polyvinyl chloride polymers which can be used include the homopolymer of vinyl chloride as well as copolymers and terpolymers of vinyl chloride monomer and various comonomers. No particular limitation is placed on the comonomers which can be used for this purpose, and specific examples thereof include vinyl alkyl esters such as vinyl acetate; acrylic acid, methacrylic acid and their esters; maleic acid and its esters; acrylonitrile; α-olefins such as ethylene and propylene; vinyl ether; and vinylidene chloride. Although no particular limitation is placed on the content of such comonomers, they are usually used in an amount of 50 mole % or less, preferably 20 mole % or less and more preferably 0.1 to 15 mole %.

No particular limitation is placed on the method for the preparation of these polyvinyl chloride polymers. That is, there can be used polyvinyl chloride polymers prepared by any of various well-known polymerization techniques such as bulk polymerization, suspension polymerization, emulsion polymerization, solution polymerization and precipitation polymerization.

These polyvinyl chloride polymers should usually have an average polymerization degree of 50 to 10,000, preferably 100 to 5,000 and more preferably 500 to 5,000. No particular limitation is placed on the form in which these polymers are used, so long as the effects of the present invention are not detracted from. These polyvinyl chloride polymers may be used in the form of a sheet or film. More specifically, they may be used by forming them into a film usually having a thickness of 10 to 200 μm, preferably 20 to 100 μm, according to any well-known technique, and this film can further be drawn before use.

The nylon polymers which can be used include 6-nylon, 11-nylon, 12-nylon, 6,6-nylon, 6,10-nylon and 6,66-nylon, as well as low-melting copolymeric nylons and blended nylons. They can be used after being formed into a film or sheet according to any commonly known technique. The aforesaid nylon polymers should preferably have a molecular weight in the range of about 1,000 to 30,000.

Thermoplastic polyester polymers, which are typified by polyethylene terephthalate (PET), can also be used. For the purpose of the present invention, PET can be used in combination with an ultra-high-molecular-weight polyethylene layer in any of the compression molding, rolling and drawing steps for an ultra-high-molecular-weight polyethylene powder, provided that a processing temperature determined with consideration for the glass transition temperature of PET is employed. Its lamination can be facilitated by substituting isophthalic acid for a portion of the terephthalic acid. Specific examples of the polyester polymers include polyethylene terephthalate and polyethylene 2,6-naphthalate. No particular limitation is placed on the molecular weights thereof, so long as they are any of various film or fiber grade products.

The coloring agents, weathering stabilizers, antistatic agents, hydrophilicity-imparting agents, adhesion promoters and dyeability-imparting agents which can be incorporated in the aforesaid thermoplastic resin film are more specifically described hereinbelow.

No particular limitation is placed on the coloring agents which can be used in the present invention, and they include a wide variety of so-called pigments commonly used in coloring resins, fibers and the like. Such coloring agents are roughly divided into organic pigments and inorganic pigments. Useful organic pigments include nitroso pigments, nitro pigments, azo pigments, phthalocyanine pigments, pigments derived from basic dyes, acid dyes and mordant dyes, and the like, and specific examples thereof are Hansa Yellow, Benzidine Yellow, Benzidine Orange, C. P. Toluidine Red Med, C. P. Para Pred Lt, Chlorinated Para Red, Ba Lithol Toner, Lithol Rubine, Permanent Red 28, BON Red OK, BON Maroon Lt, Pigment Scarlet Lake, Madder Lake, Thioindigo Red, Pyrazolone Red, Dibenzanthrone Violet, Helio Fast Ruby, Diazo Green, Diazo Yellow, Cyanine Blue, Cyanine Green, Phthalocyanine Blue, Phthalocyanine Green, Indanthrene Blue, quinacridone, Fast Yellow, Brilliant Carmine 68, Azo Red, Lake Red, Lake Bordeaux and Fast Sky Blue. Useful inorganic pigments include chromic acid, ferrocyanides, sulfides, sulfates, oxides, hydroxides, silicates, carbon black and the like, and specific examples thereof are cobalt pigments such as aureolin, cobalt green, cerulean blue, cobalt blue and cobalt violet; iron pigments such as yellow ochre, sienna, red oxide and Prussian blue; chromium pigments such as chromium oxide, chrome yellow and viridian; manganese pigments such as mineral violet; copper pigments such as emerald green; vanadium pigments such as vanadium yellow and vanadium blue; mercury pigments such as vermilion; lead pigments such as red lead; sulfide pigments such as cadmium yellow and ultramarine; selenide pigments such as cadmium red; and finely divided aluminum powder. Although the particle diameters of these pigments may range from several tens of millimicrons to several microns and the particles thereof may have various shapes such as spherules, aggregates, rods, needles and flakes, pigments having any particle diameter and any particle shape can be used in the present invention. These pigments may used alone or in admixture.

The weathering stabilizers which can be incorporated in the thermoplastic resin film according to the present invention include oxidation inhibitors such as radical chain terminators and peroxide decomposers, as well as ultraviolet light absorbers. Specific examples thereof are as follows:

(Oxidation inhibitors)

Radical chain stoppers: Amine compounds such as phenyl-α-naphthylamine, phenyl-β-naphthylamine, diphenylamine, N,N'-diphenyl-p-phenylenediamine, N,N'-di-β-naphthyl-p-phenylenediamine, p-hydroxyldiphenylamine, p-hydroxyphenyl-β-naphthylamine, 2,2,4-trimethyldihydroquinoline, di-β-naphthyl-p-phenylenediamine, N-phenyl-N'-cyclohexylparaphenylene-p-phenylenediamine, N-isopropyl-N'-phenyl-p-phenylenediamine and aldol-α-naphthylamine; phenolic compounds such as p-hydroxyphenylcyclohexane, di-p-hydroxyphenylcyclohexane, 2,6-di-t-butylphenol, styrenated phenol, 1,1'-methylenebis(4-hydroxy-3,5-di-t-butylphenol), 2,2'-methylenebis(4-methyl-6-t-butylphenol), 2,6-(2-t-butyl-4-methyl-6-methylphenyl)-p-cresol, 2,2'-thiobis(4-methyl-6-t-butylphenol), 4,4'-thiobis(4-methyl-6-t-butylphenol), 4,4'-butylidenebis(4-methyl-6-t-butylphenol), di-β-naphthyl-p-phenylenediamine, N-phenyl-N'-cyclohexylparaphenylene-p-phenylenediamine, N-isopropyl-N'-phenyl-p-phenylenediamine and aldol-α-naphthylamine; and the like.

Peroxide decomposers: 4,4'-Thiobis(3-methyl-6-t-butylphenol), thiobis(β-naphthol), thiobis(N-phenyl-β-naphthylamine), mercaptobenzothiazole, mercaptobenzimidazole, dodecyl mercaptan, tetramethylthiuram monosulfide, tetramethylthiuram disulfide, tri (nonylphenyl) phosphite, dilauryl thiodipropionate, distearyl thiodipropionate and the like.

(Ultraviolet light absorbers)

There can be used benzophenone compounds such as 2-hydroxy-4-methoxybenzophenone, 2,2'-dihydroxy-4-methoxybenzophenone, 2-hydroxy-4-methoxy-4'-chlorobenzophenone, 2,2'-dihydroxy-4-n-octoxybenzophenone, 2-hydroxy-4-n-octoxybenzophenone, 2,4-dihydroxybenzophenone, 2,4-dibenzoylresorcinol, resorcinol monobenzoate, 5-chloro-2-hydroxybenzophenone, 2,2'-dihydroxy-4,4'-dimethoxybenzophenone, 4-dodecyl-2-hydroxybenzophenone, 2,2,4'-tetrahydroxybenzophenone; benzotriazole compounds such as 2-(2'-hydroxy-5'-methylphenyl)benzotriazole, alkylated hydroxyphenylbenzotriazole,

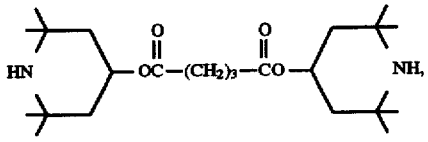

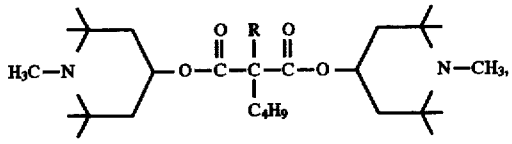

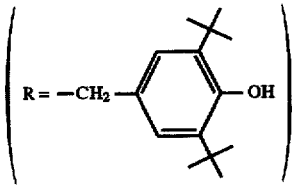

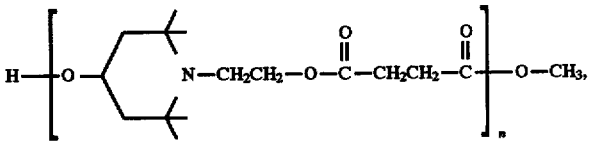

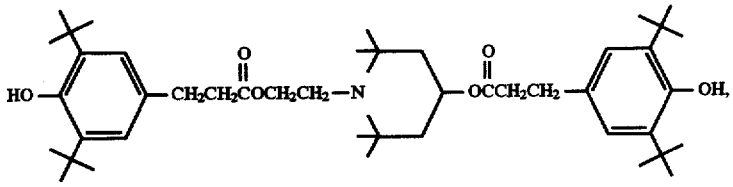

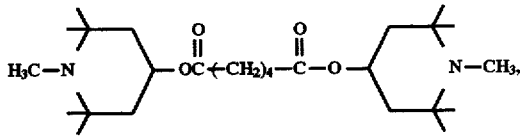

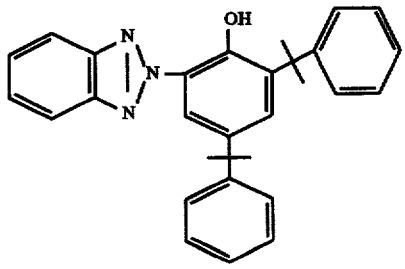

and

-continued

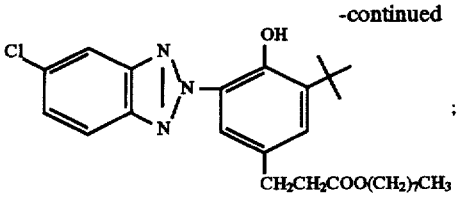

;

salicylate compounds such as phenyl salicylate, 4-t-butylphenyl salicylate and p-octylphenyl salicylate; dicyanoacrylate compounds; and the like. In addition, light stabilizers such as hindered amine compounds (e.g., hindered piperidine compounds) can also be used.

Other usable additives include carbon black; metal powders such as aluminum powder and copper powder; and powdered metallic oxides such as aluminum oxide, iron oxide and titanium oxide. Furthermore, there can also be used alumina, silicon carbide, barium carbonate, and fine ceramics (also known as new ceramics, advanced ceramics, modern ceramics or high-tech ceramics) including $Al_2O_3$, BeO and SiC(+BeO) compositions serving, for example, to provide an electromagnetic function such as electrical insulation, $Y_2OS$ (Eu-doped) serving to provide an optical function such as fluorescence, and the like.

The antistatic agents which can be incorporated in the thermoplastic resin film include nonionic, anionic, cationic and amphoteric surface-active agents, and specific examples thereof are as follows:

(Nonionic surface-active agents)

Polyoxyethylene-alkylamines, polyoxyethylene-alkylamides,

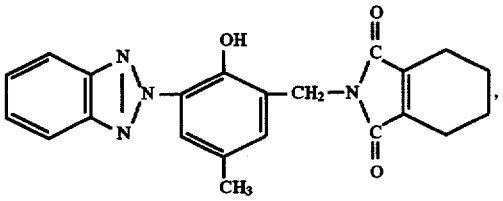

,

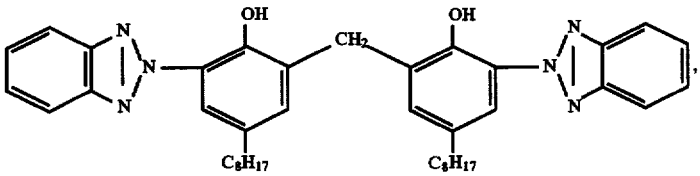

, $H(OCH_2CH_2)_nOH$ (n = 3~11),

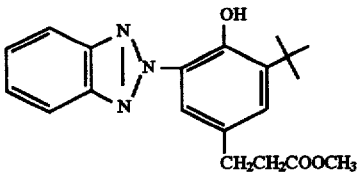

condensate,

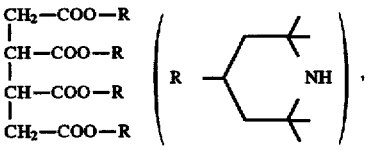

,

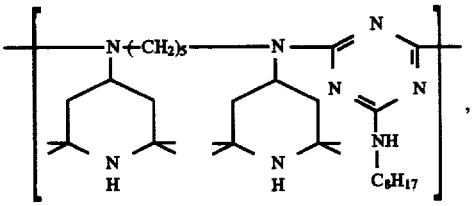

,

-continued

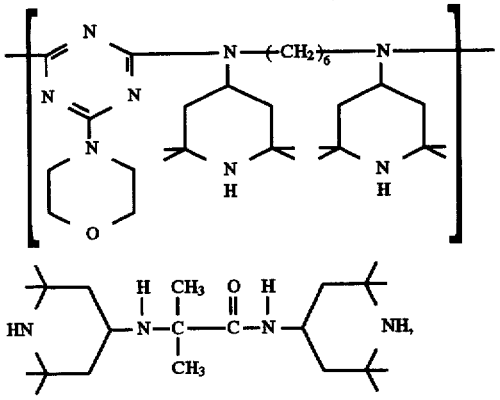

polyoxyethylene glycol alkyl ethers, polyoxyethylene glycol alkylphenyl ethers, glycerol fatty acid esters, sorbitan fatty acid esters, stearic acid monoglyceryl ester, stearyl diethanolamine and the like.

(Anionic surface-active agents)

Alkyl sulfonates, alkylbenzene sulfonates, $RSO_3Na$, alkyl sulfates, $ROSO_3Na$, alkyl phosphates, $ROPO_3K_2$, polyphosphates, pentaalkyl tripolyphosphates and the like.

(Cationic surface-active agents)

Quaternary ammonium salts such as ammonium chloride, ammonium sulfate and ammonium nitrate; alkylamine salts; the adducts of a higher amine with ethylene oxide; and the like.

(Amphoteric surface-active agents)

Alkylbetains; and aminocarboxylic acid derivatives, alanine type amphoteric surface-active agent metal salts, imidazoline type amphoteric surface-active agent metal salts, diamine type amphoteric surface-active agent metal salts and Ethylene oxide unit containing amphoteric surface-active agent metal salts, such as

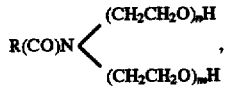

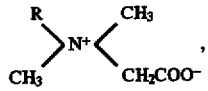

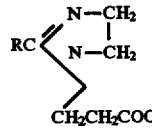

and

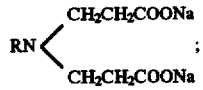

and the like.

Other antistatic agents include cupric chloride, carbon and the like, as well as polyvinylbenzil cation, polyacrylic acid cation, and the like.

The adhesion promoters which can be incorporated in the thermoplastic resin film include uncured epoxy resins (in granular or powder form), uncured unsaturated polyesters (in granular or powder form), modified polyamides and the like. Specific examples of the aforesaid epoxy resins include bisphenol A-based epoxy resins that are glycidyl derivatives of bisphenol A formed by reaction with epichlorohydrin, which are commercially available, for example, from Nippon Pelnox Corporation under the trade names of Pelpowders PE-05, PE-10 and PCE-273°. Preferred examples of the aforesaid unsaturated polyesters include so-called N-type unsaturated polyesters derived chiefly from an isophthalic acid compound or a hydrogenated bisphenol compound.

The dyeability-imparting agents which can likewise be incorporated therein include polyvinyl alcohol powder having a degree of saponification of 80% or greater, preferably 95% or greater (for example, commercially available from Kuraray Co., Ltd. under the trade names of Kuraray Povals PVA-117, PVA-CS, PVA-217 and PVA-205), cellulose powder, acetate powder, for example, having an MFR (190° C.) of 0.1–2 g/min, polyamide powder and the like.

The hydrophilicity-imparting agents which can likewise be incorporated therein include the same polyvinyl alcohol powder as described above, chitosan having antibacterial properties and chelating properties, acrylic acid and the like.

In the present invention, at least one additive selected from the group consisting of the above-described coloring agents, weathering stabilizers, antistatic agents, hydrophilicity-imparting agents, adhesion promoters and dyeability-imparting agents is incorporated in an olefin polymer, nylon polymer, polyester polymer or polyvinyl chloride polymer as described above, and the resulting blend is formed into a film. This can be accomplished, for example, by preparing a masterbatch comprising a polymer powder or pellets having one or more additives incorporated therein at high concentrations and melt-blending it with a base polymer. Moreover, no particular limitation is placed on the method for forming the resulting blend into a film or sheet, and a material obtained by extruding the molten resin through a T-die or circular die on an ordinary extruder can be used directly.

The amount of various additives incorporated in the above-described thermoplastic resin film is usually in the range of 0.01 to 50% by weight, preferably 0.05 to 40% by weight, based on the thermoplastic resin. More specifically, adhesives are usually used in an amount of 0.5 to 30% by weight, preferably 1 to 25% by weight; weathering stabilizers are usually used in an amount of 0.01 to 10% by weight, preferably 0.05 to 5% by weight; and antistatic agents are usually used in an amount of 0.01 to 10% by weight, preferably 0.05 to 5% by weight. Hydrophilicity-imparting agents, adhesion promoters and dyeability-imparting agents are usually used in an amount of 1 to 20% by weight, preferably 2 to 15% by weight.

With regard to the morphology of the thermoplastic resin film having the above-described various additives incorporated therein, no particular limitation is placed on the thickness thereof, so long as it does not exceed that of the core material to be compression-molded, rolled or drawn. The thickness ratio of the core material to the film should be in the range of 60/40 to 98/2 and preferably 70/30 to 95/5. More specifically, the thickness of the thermoplastic resin film should usually be in the range of about 0.005 to 1 mm. The width thereof should be equal to that of the core material, though films having a somewhat larger or smaller width can be used without any difficulty.

The thermoplastic resin film which is laminated to the ultra-high-molecular-weight polyethylene film material in the rolling step and, if necessary, the drawing step may comprise, for example, a single olefin polymer film or a single nylon polymer film. Alternatively, a plurality of such thermoplastic resin films may be used so as to interpose the ultra-high-molecular-weight polyethylene film material therebetween. Furthermore, the thermoplastic resin film may comprise a laminated composite film consisting of one or more olefin polymer layers and one or more nylon polymer or polyester polymer film layers. In this case, desired additives can be incorporated only in some film layers.

That is, according to the intended purpose and the form of the product, various modifications can suitably be made, for example, with consideration for colorability, weather resistance or antistatic properties to be imparted to the product, or suitability for lamination of the polyethylene material having high strength and high modulus of elasticity (i.e., adhesion properties thereof during lamination).

Now, the method for the production of a polyethylene material having high strength and high modulus of elasticity is specifically described hereinbelow. In the present invention, as stated before, a polyethylene material having high strength and high modulus of elasticity is produced by allowing a thermoplastic resin film or films as described above to coexist in the rolling step and, if necessary, the drawing step for processing an ultra-high-molecular-weight polyethylene film material. The term "laminate" as used herein means to disperse the thermoplastic resin film in the interior and/or surface of the ultra-high-molecular-weight polyethylene film material. In this case, the ultra-high-molecular-weight polyethylene film material should be indispensably included as core material.

Typical processes for accomplishing this purpose include:

(1) a laminate molding process for laminating a thermoplastic resin film to one or either side of an ultra-high-molecular-weight polyethylene film material in the rolling step; and (2) a laminate molding process for further laminating a thermoplastic resin film to one or either side of the ultra-high-molecular-weight polyethylene film material in the drawing step, if necessary.

As stated before, these laminate molding processes may be suitably modified in connection with the properties of the desired molded product and the diversity of the thermoplastic resin film. For example, different types of thermoplastic resin films may be laminated in the rolling and drawing steps. Thus, no particular limitation is placed on the manner of lamination.

Now, the ultra-high-molecular-weight polyethylene film material is explained in detail. Specific examples of this film material include one obtained by a process of melting an ultra-high-molecular-weight polyethylene as described above and forming the molten material into a film by extrusion or other technique, one obtained by a process of dissolving an ultra-high-molecular-weight polyethylene in a large volume of a solvent and preparing a film-like gel from this solution or a process of forming a film from such a film-like gel, and one obtained by a process of forming an ultra-high-molecular-weight polyethylene into a film in a solid phase without dissolving it in a solvent and without subjecting it to a melting step. Especially preferred is a film material obtained by a process of forming an ultra-high-molecular-weight polyethylene into a film in a solid phase.

One preferred example of the process of forming an ultra-high-molecular-weight polyethylene into a film in a solid phase is a process of forming an ultra-high-molecular-weight polyethylene film material by compression-molding an ultra-high-molecular-weight polyethylene powder. In this compression molding process, the compression molding step should be carried out at a temperature lower than the melting point of the polyethylene powder which is a material to be compressed, and this fact is very important in obtaining a polyethylene material having high strength and high modulus of elasticity through subsequent rolling and drawing steps. However, in order to obtain a good compression-molded sheet, this temperature should be in an acceptable range lower than the melting point, i.e., usually 20° C. or above and lower than the melting point, preferably 50° C. or above and lower than the melting point, more preferably from 90° to 140° C., and most preferably from 110° to 135° C. Although no particular limitation is placed on the pressure used in the compression molding step, it is usually less than 1,000 kg/cm$^2$ and preferably in the range of 0.1 to 1,000 kg/cm$^2$.

No particular limitation is placed on the type of the compression molding apparatus, so long as an ultra-high-molecular-weight polyethylene powder can be continuously compression-molded by a rotary pressing means. As the rotary pressing means, there may be used one or more pairs of rolls facing each other, one or more pairs of endless belts, and a combination of endless belts and rolls. One preferred embodiment of the compression molding apparatus is described with reference to FIG. 1.

Basically, this apparatus has a pressing means composed of a pair of upper and lower endless belts 5, 6 which face each other and are tensioned by rolls 1 to 4, a pressing plate 7 for pressing the powder via each endless belt, and a series of chain rollers 8 which are linked to each other and can rotate between the pressing plate and the endless belt.

This pressing means comprises the pressing plate disposed inside each endless belt and the series of chain rollers which are linked to each other and can rotate between the pressing plate and the endless belt. Preferably, this series of chain rollers which are linked to each other and can rotate between the pressing plate and the endless belt are disposed so that the shafts of the rollers are substantially perpendicular to the running direction of the endless belt, and closely arranged to such a degree that the rollers do not come into contact with each other.

At opposite ends, the shafts of these rollers are fastened to chains, each of which is engaged with sprockets 9, 10 disposed in the front and rear of the pressing plate. Thus, the series of rollers are preferably made to run at a speed equal to about one-half the running speed of the endless belt.

This series of rollers may be fixed between the endless belt and the pressing plate. In this case, however, the durability of the apparatus may pose a problem because frictional forces are generated due to slips between the rollers and the endless belt and between the rollers and the pressing plate.

Any pressing plate can be used without restriction, so long as its surface in contact with the series of rollers is smooth and it can transmit pressure uniformly.

Although no particular limitation is placed on the length of the pressing plate in the running direction of the endless belt, it usually ranges from 30 to 400 cm and preferably from 50 to 200 cm. Although the average pressure applied to the endless belt by the pressing plate may be suitably chosen, it is usually less than 200 kg/cm$^2$, desirably less than 100 kg/cm$^2$, preferably from 0.1 to 50 kg/cm$^2$, more preferably from 0.1 to 20 kg/cm$^2$, still more preferably from 0.5 to 10 kg/cm$^2$. The primary function of the pressing plate is to press the polyethylene powder via the endless belt, but the pressing plate can simultaneously be used as a means for heating the material to be compressed. As stated before, it is very important in the present invention that the compression molding step be carried out at a temperature lower than the melting point of the polyethylene powder which is the material to be compressed. This temperature usually ranges from 20° C. to less than the melting point, preferably from 50° C. to less than the melting point, more preferably from 90° to 140° C. and most preferably 110° to 135° C.

As a means for heating the material to be compressed, it is best to directly heat the endless belts in the pressing section. However, it is practically convenient to dispose a heating means in each pressing plate and thereby heat the material to be compressed through the medium of the rollers and the endless belt, or to install a preheater 11 in proximity to the endless belts as shown in FIG. 1 and thereby heat the material to be compressed.

The disposition of a heating means in each pressing plate can be accomplished by providing the pressing plate with a heat insulating material and embedding an electric heater therein or by providing the pressing plate with a passage for the circulation of a heating medium and passing a heating medium therethrough.

In carrying out the method for the continuous production of a polyethylene material having high strength and high modulus of elasticity by using the illustrated apparatus, an ultra-high-molecular-weight polyethylene powder placed in a hopper 12 is made to drop on the lower endless belt 6.

Although the running speed of the endless belt depends on the length of the pressing plate and the compression conditions, it usually ranges from 10 to 500 cm/min and preferably from 50 to 200 cm/min. The polyethylene powder on the endless belt is adjusted with a doctor knife 16 so as to have a desired cross section, and preheated by the preheater 11, if necessary. Thereafter, the polyethylene powder is moved to a squeezing section defined by the upper and lower endless belts, and then forwarded to a pressing section in which the rollers and the pressing plates are disposed. In this pressing section, pressure from a hydraulic cylinder 15 is transmitted to the pressing plate, so that a compression force is applied to the material to be compressed through the medium of the rollers and the endless belt. At the same time, heat from the heater is likewise transferred to the material to be compressed through the medium of the rollers and the endless belt, so that the material to be compressed is maintained at a predetermined temperature.

Thus, the ultra-high-molecular-weight polyethylene powder is compression-molded to form an ultra-high-molecular-weight polyethylene film material, which is then wound on a take-up roll 17.

No particular limitation is placed on the process of melting an ultra-high-molecular-weight polyethylene and forming the molten material into a film by extrusion or other technique which is an alternative process for forming an ultra-high-molecular-weight polyethylene film material. However, in a typical and preferred embodiment thereof, an ultra-high-molecular-weight polyethylene in its molten state is extruded through a tubular die or T-die by means of a screw extruder (preferably having a high L/D ratio) or the like and then drawn several times to about ten times as required.

Similarly, no particular limitation is placed on the process of dissolving an ultra-high-molecular-weight polyethylene in a large volume of a solvent and preparing a film-like gel from this solution or the process of forming a film from such a film-like gel which are other alternative processes for forming an ultra-high-molecular-weight polyethylene film material. However, in a preferred embodiment thereof, a solution of an ultra-high-molecular-weight polyethylene (usually having an ultra-high-molecular-weight polyethylene concentration of not greater than 30% by weight) is forced through a spinneret and withdrawn in the form of a tape or film. After being cooled as required, the resulting film-like gel is partially or completely freed of solvent and then drawn, if necessary.

Now, the method for laminating the thermoplastic resin film to the ultra-high-molecular-weight polyethylene film material in the rolling step is described hereinbelow.

Although the film material formed by compression molding can be rolled in any well-known manner, a rolled film may be obtained by nipping the resulting compression-molded sheet between a pair of pressure rolls having the same or different rotational directions while maintaining the compression-molded sheet in a solid phase without melting it. In this case, the deformation ratio of the material by the rolling operation can be chosen in a wide range, and this ratio should usually be in the range of 1.2 to 20, preferably 1.5 to 10, as expressed in terms of rolling efficiency (i.e., the ratio of the length after rolling to the length before rolling). This rolling operation is usually carried out at a temperature ranging from 20° C. to less than the melting point of the ultra-high-molecular-weight polyethylene film material, preferably from 50° C. to less than the melting point, more preferably from 90° to 140° C. and most preferably from 110° to 135° C. Of course, the aforesaid rolling operation may be carried out in two or more stages.

Figure 2:
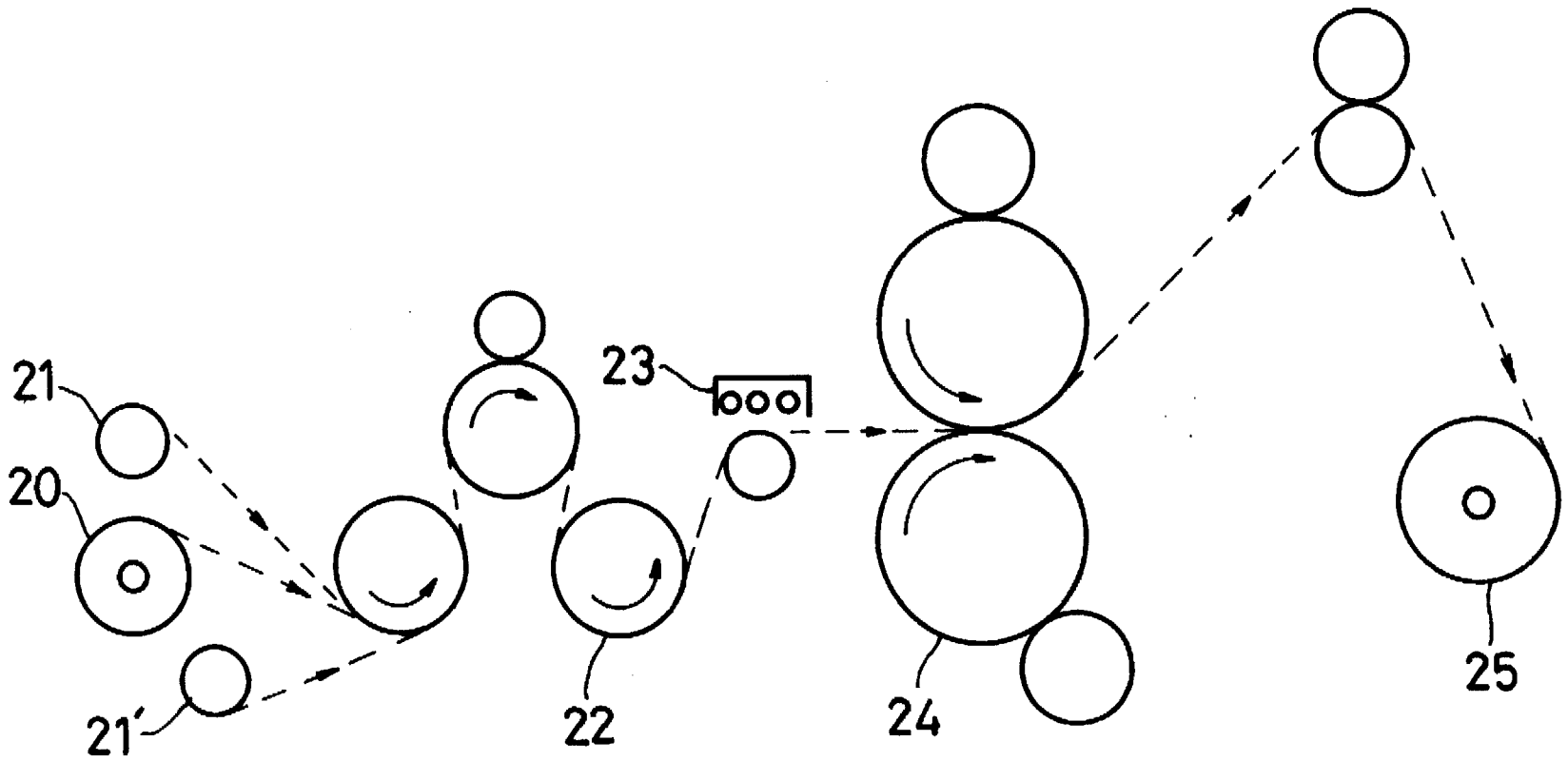
FIG. 2 is a schematic illustration of one exemplary apparatus suitable for carrying out the rolling step.

In order to allow a thermoplastic resin film or films to coexist in this rolling step, the following method is commonly employed. Referring to FIG. 2 which illustrates a typical rolling apparatus, the ultra-high-molecular-weight polyethylene film material delivered from a feed roll 20 is brought into contact with thermoplastic resin films delivered from feed rolls 21 and 21' which are disposed above or below, or above and below, the feed roll 20. The resulting assembly is preheated on the surfaces of a plurality of preheat rolls 22, preheated again by an infrared preheater 23, if necessary, and then rolled by a pair of pressure rolls 24. Thereafter, the resulting rolled sheet is wound on a take-up roll 25.

Thus, the method of laminating the thermoplastic resin film(s) to the ultra-high-molecular-weight polyethylene film material in the rolling step has the advantage, for example, of simplifying the process, as compared, for example, with the method of laminating it in the compression molding step of the ultra-high-molecular-weight polyethylene powder. The drawing step following the rolling step can also be carried out in various manners. Usable drawing means include hot-air drawing, cylinder drawing, roll drawing, hot plate drawing and the like. However, it is common practice to draw the material between a pair of nip rolls or clover rolls having different speeds.

Figure 3A:
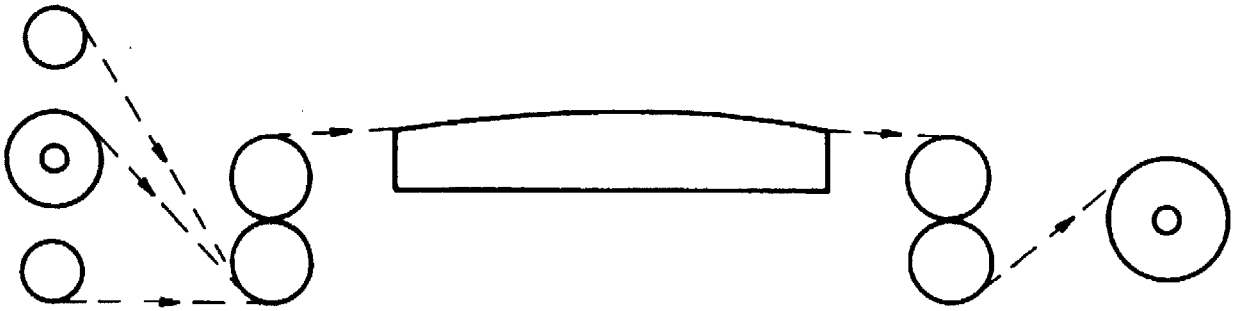
FIGS. 3(*a*) and 3(*b*) are a schematic illustration of two exemplary apparatus suitable for carrying out the drawing step.
Figure 3B:
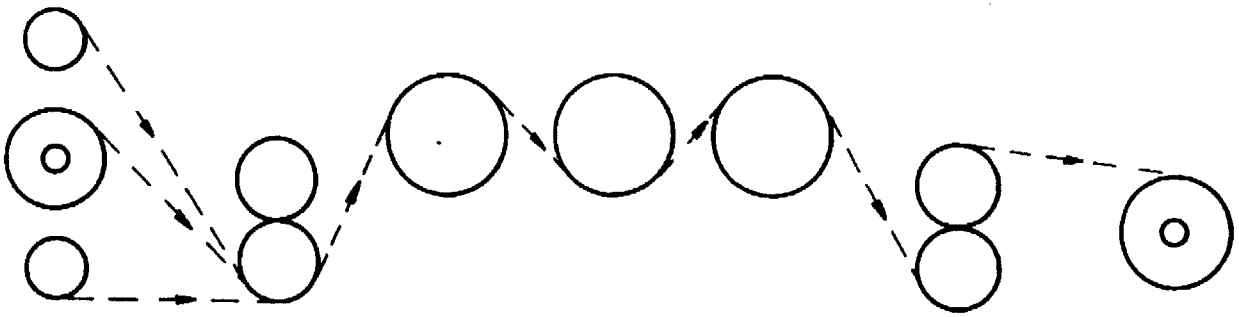

As typical drawing apparatus which, if necessary, enable a thermoplastic resin film or films to coexist with the ultra-high-molecular-weight polyethylene rolled sheet, an apparatus using a hot plate is shown in FIG. 3(*a*) and an apparatus using heated rolls in FIG. 3(*b*). Briefly, the apparatus of FIG. 3(*a*) operates in substantially the same manner as that of FIG. 2. That is, the ultra-high-molecular-weight polyethylene rolled sheet delivered from a feed roll and thermoplastic resin films are delivered from feed rolls disposed above or below, or above and below, the feed roll of the rolled sheet. They are brought into contact by feed pinch rolls, drawn on a drawing hot plate while being taken off by take-off pinch rolls, and wound on a take-up roll. If desired, before wound on the take-up roll, the drawn material may be split to form a tape yarn, or slit and then split to form a split yarn. In the apparatus of FIG. 3(*b*), drawing is carried out by using three drawing heated rolls in place of the drawing hot plate and varying the rotational speeds of the rolls as required.

The above-described drawing operation should be carried out at a temperature lower than the melting point of the material to be drawn. More specifically, the drawing temperature is usually in the range of 20° to 160° C., preferably 60° to 150° C., more preferably 90° to 145° C. and most preferably 90° to 140° C. Again, the drawing step may be carried out not only in one stage but also in two or more stages. In the latter case, it is preferable to carry out the second stage at a higher temperature than the first stage.

The drawing speed, which varies according to the method of tensile drawing, the molecular weights of the polymers, and the composition thereof, may be suitably chosen. However, it usually ranges from 1 mm/min to 500 m/min. More specifically, in the case of batch drawing, the drawing speed is usually in the range of 1 to 500 mm/min, preferably 1 to 100 mm/min and more preferably 5 to 50 mm/min, while in the case of continuous drawing, it is usually in the range of 0.1 to 500 m/min at an outlet speed, preferably 1 to 200 m/min and more preferably 10 to 200 m/min. From an economic point of view, it is more preferable to employ higher drawing speeds.

Since higher draw ratios make it possible to achieve higher strengths and higher moduli of elasticity, it is preferable to enhance the draw ratio as much as possible. In the present invention, the total draw ratio (i.e., the combined draw ratio resulting from rolling and tensile drawing) can usually be 20 or greater, preferably 60 or greater and more preferably in the range of 80 to 200. Thus, the drawing step can be carried out at vary high draw ratios.

When only an ultra-high-molecular-weight polyethylene powder is subjected to a compression molding step, a rolling step and a drawing step in the above-described manner, the tensile modulus of elasticity of the resulting drawn material is usually 60 GPa or greater, more frequently in the range of 80 to 180 GPa and most frequently in the range of 120 to 150 GPa. Moreover, its tensile strength has a very high value which is usually 0.7 GPa or greater, more frequently in the range of 1.0 to 5.0 GPa and most frequently in the range of 1.5 to 3.0 GPa.

In the present invention, a thermoplastic resin powder or film which has been suitably selected according to the desired properties is laminated to an ultra-high-molecular-weight polyethylene film material as described above, and the physical properties of the resulting drawn material may vary to some degree. Specifically, its tensile modulus of elasticity is usually in the range of 40 to 180 GPa and more frequently in the range of 100 to 150 GPa, and its tensile strength is usually in the range of 0.7 to 5.0 GPa and more frequently in the range of 1.0 to 3.0 GPa.

Thus, the present invention has an outstanding feature in that, even though a thermoplastic resin powder or film coexists, a drawn material having substantially equal or only slightly reduced physical properties can be obtained.

Although the high-strength and high-modulus-of-elasticity polyethylene material of the present invention can be used for any desired purposes, a high-strength and high-modulus-of-elasticity polyethylene material having more excellent properties can be obtained by using it as yarn. In this respect, the present invention is further explained hereinbelow.

The term "yarn" as used herein comprehends tape yarns such as multifilament yarn, monofilament yarn and tape-like filament yarn, as well as split yarn. First of all, the subsequent formation of split yarn typifying the high-strength and high-modulus-of-elasticity polyethylene material of the present invention is described in detail.

Split yarn, which is an end product symbolizing the characteristics of the high-strength and high-modulus-of-elasticity polyethylene material of the present invention, is produced by splitting the aforesaid drawn material of the ultra-high-molecular-weight polyethylene. No particular limitation is placed on the splitting method, and any well-known method may be employed. Examples thereof include mechanical methods in which the drawn material in film or sheet form is beaten, twisted, abraded or brushed, an air jet method, an ultrasonically splitting method, and an explosion method in which the drawn film is exposed to a blast from an explosion.

Figure 4:
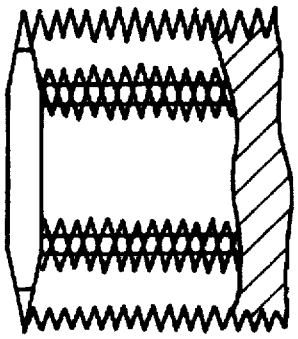
FIG. 4 is a fragmentary view illustrating one exemplary tap-like splitter suitable for use in the practice of the present invention.
Figure 5:
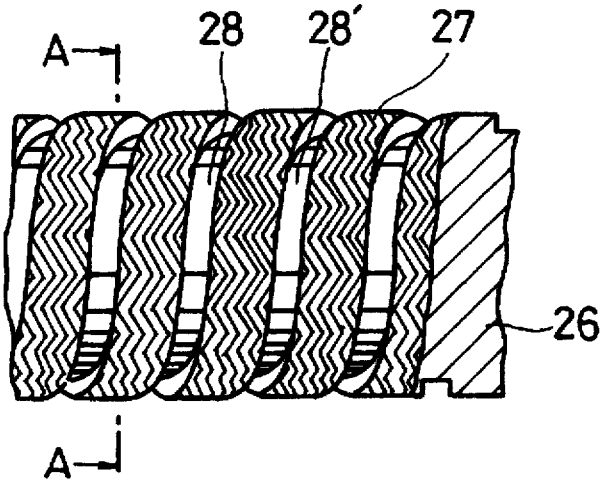
FIG. 5 is a fragmentary view illustrating one exemplary file-like splitter suitable for use in the practice of the present invention.

In the present invention, it is preferable to employ a mechanical method and, in particular, a rotary mechanical method. Such mechanical methods include, for example, ones using various type of splitters such as a tap-like splitter, a file-like rough surface splitter and a needle roll splitter. A preferred tap-like splitter usually comprises a pentagonal or hexagonal body (FIG. 4) having 10 to 40, preferably 15 to 35, threads per inch. A preferred file-like splitter is one devised by the present inventors (Japanese Utility Model No. 38980/'76) and shown in FIG. 5. In FIG. 5, the surface 27 of a shaft 26 of circular cross section comprises the surface of a metal-working round file or an analogous rough surface, and two helical channels 28 and 28' are grooved at equal pitches.

Figure 6:
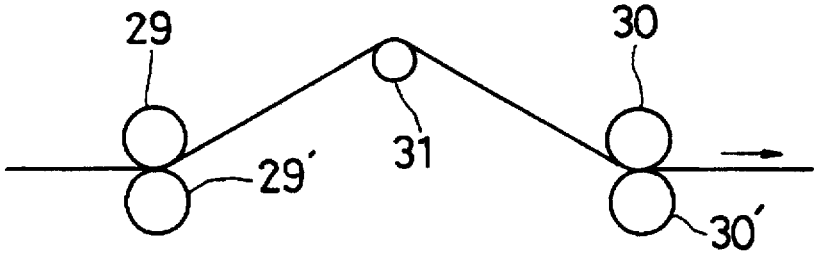
FIG. 6 is a schematic illustration of one exemplary apparatus suitable for carrying out the splitting step.

Although no particular limitation is placed on the splitting apparatus used, a basic and typical example thereof is one in which, as shown in FIG. 6, a rotary splitter 31 is disposed between nip rolls 29, 29' and nip rolls 30, 30' and the drawn material is moved under tension so as to come into contact with the rotary splitter. Although no particular limitation is placed on the running speed of the drawn material, it is usually in the range of 1 to 1,000 m/min and preferably 20 to 300 m/min. The rotational speed (peripheral speed) of the splitter may be suitably chosen according to the physical properties of the drawn material, the running speed thereof, and the properties of the desired split yarn. However, it is usually in the range of 10 to 3,000 m/min and preferably 50 to 1,000 m/min. The contact angle between the drawn material and the splitter is usually in the range of 30 to 180 degrees and preferably 60 to 90 degrees. Since a drawn tape is liable to slip, it may be difficult to maintain a predetermined tape speed at the nip rolls disposed before and behind the splitter. Accordingly, it is desirable to take an anti-slip measure by using a combination of a nip roll and a clover roll, Nelson rolls, or both of them.

In carrying out the splitting operation by brushing or by use of a rotary splitter, the drawn material is preferably placed under tension. In view of the previously described high tensile modulus of elasticity, the drawn material should be processed so that its degree of deformation is usually in the range of 0.1 to 3% and preferably 0.5 to 2%. In this case, the use of a tension controller such as a dancer roll is an effective means for maintaining a constant tape tension in the splitting apparatus.

The temperature employed for the splitting operation usually ranges from −20° to +100° C., preferably from −5° to +50° C. and more preferably from 0° to 20° C. The splitting operation may be carried out not only in a single stage, but also in two or more stages. Moreover, thick materials may be split from both sides. Specific examples of the splitting method are described in U.S. Pat. Nos. 2,185,789, 3,214,899, 2,954,587, 3,662,935 and 3,693,851, and Japanese Patent Publication Nos. 13116/'62 and 16909/'78.

The split yarn obtained by the above-described method usually has a thickness of 10 to 200 μm and preferably 30 to 100 μm. If the thickness is less than 10 μm, the drawn material in film or sheet form may be torn longitudinally and, moreover, split fibrils may fluff and twine round the splitter, making the quality and process unstable. If the thickness is greater than 200 μm, the drawn material tends to have poor splittability. The split width is usually in the range of 10 to 500 μm and preferably 50 to 200 μm.

The split yarn obtained according to the present invention is characterized by having excellent flexibility and high strength in addition to the effects produced by the addition of a pigment, weathering stabilizer, antistatic agent or the like. The strength after splitting is usually 0.4 GPa or greater, and can be enhanced by twisting to a level almost equal to the strength before splitting. When twisted by a number of twist in the range of 50 to 500 turns per meter, the maximum tensile strength is at least 0.7 GPa or greater, frequently 1 GPa or greater, and more frequently 1.5 GPa or greater. This value is equivalent to a high strength of about 8 g/d or greater, frequently about 11.5 g/d or greater, and more frequently about 17 g/d or greater.

Since the drawn polyethylene material used in the present invention has no polar group and hence no surface activity, it is generally difficult to print on or bond to the surface thereof. Accordingly, if necessary, the drawn polyethylene material may suitably be subjected to a surface treatment such as corona discharge treatment, plasma treatment, chemical oxidation treatment or flame treatment, before splitting or preferably after splitting.

The properties of the polyethylene material obtained by the above-described method, i.e., by laminating a thermoplastic resin film having an additive or additives incorporated therein to an ultra-high-molecular-weight polyethylene film material in the rolling step, drawing the rolled material and then slitting or splitting the resulting polyethylene material having high strength and high modulus of elasticity, may vary greatly according to the type and amount of thermoplastic resin powder or film used, the method of lamination, and the like. In this connection, the properties of the slit or split material without laminating a thermoplastic resin having an additive or additives incorporated therein can be characterized as follows.

The slit material comprises a plurality of elongated rectangular tapes which are separated from each other, while the split material forms a reticulate structure in which filaments are not separated from each other but joined to each other. With a film having a thickness, for example, of 60 μm, the slit width is limited to about 1.6 mm. In this case, the slit material has an approximate fineness of 800 to 900 d. In contrast, the split width of the split material is generally in the range of 10 to 500 μm and has a logarithmic mean of about 70 μm, and the split thickness thereof is in the range of 10 to 200 μm and has a Logarithmic mean of about 45 μm. Such a split material has an approximate fineness of 30 d.

In this connection, the flexibility of the aforesaid 1.6 mm slit material as defined by the following equation is about 2,660 mg.cm and the flexibility of the aforesaid split material is about 980 mg.cm.

$$\text{Flexibility } (G) = \text{Unit area } (W) \times \left[ \frac{\text{Overhang length } (O)}{2} \right]^3$$

where measurements are made in a state twisted by 250 turns per meter.

In view of the fact that the flexibility of the aforesaid polyethylene material before slitting is about 3,500 mg.cm, it can be seen that a more desirable polyethylene material having high strength, high modulus of elasticity and high flexibility is obtained by further subjecting the aforesaid high-strength and high-modulus-of-elasticity polyethylene material to a slitting step or preferably a splitting step.

The drawn and split polyethylene material of the present invention may be used as such or in a twisted state. Although no particular limitation is placed on the number of twist, it is usually in the range of about 50 to 500 turns per meter. However, a number of twist in the range of about 100 to 300 turns per meter is preferred because high strength is achieved. Although no particular limitation is placed on the temperature at which the twisting is carried out, it is usually in the range of 0° to 100° C. and preferably 10° to 60° C.

EXAMPLE 1

(1) Preparation of a thermoplastic resin film

A base polymer comprising high-density polyethylene (manufactured and sold by Nippon Petrochemicals Co., Ltd. under the trade name of Staflene E-710; M1:1.0) was mixed with 15% by weight of Azo Red, and this mixture was processed on a melt extruder to obtain a masterbatch. Then, a mixture of 20 parts by weight of the masterbatch and high-density polyethylene (manufactured and sold by Nippon Petrochemicals Co., Ltd. under the trade name of Staflene E-710; M1:1.0) was kneaded at 230° C. and then continuously extruded to form a film having a thickness of 0.02 mm.

(2) Production of a high-strength material (Compression molding)

Specifications of compression molding machine

1. Rolls Diameter: 500 mm
   Length: 300 mm
2. Steel belts Thickness: 0.6 mm
   Width: 200 mm
3. Small-diameter rollers Diameter: 12 mm
   Length: 250 mm
4. Pressing plates Length: 1,000 mm
   Width: 200 mm
5. Hydraulic cylinder Diameter: 125 mm Using a compression molding machine defined as above, an ultra-high-molecular-weight polyethylene powder (having an intrinsic viscosity [η] of 14 dl/g as measured in decalin at 135° C. and a viscosity-average molecular weight of 2,000,000) was put between a pair of steel belts, heated to 130° C., pressed under an average pressure of about 6 kg/cm$^2$ (the pressure exerted by the hydraulic cylinder being transferred through the pressing plate, the small-diameter rollers and the steel belt in that order), and continuously compression-molded at a speed of 1 m/min.

As a result, there was obtained a sheet having a thickness of 1.1 mm and a width of 100 mm.

(Rolling)

A pair of the aforesaid thermoplastic resin films (about 100 mm wide) having Azo Red incorporated therein were interposed between a pair of rolls (with a diameter of 250 mm, a length of 300 mm and a roll spacing of 0.07 mm) which were disposed above and below, rotated in opposite directions at the same speed, and adjusted to a surface temperature of 140° C. Then, the foregoing compression-molded sheet was fed between the pair of films and rolled at an inlet speed of 1 m/min and an outlet speed of 7 m/min. Thus, there was obtained a colored rolled sheet having a thickness of 0.157 mm (i.e., a reduction ratio of 7) and a width of 98 mm).

(Drawing)

Specifications of drawing apparatus

1. Three preheating rolls Diameter: 250 mm

Length: 200 mm

2. Drawing rolls Diameter: 125 mm

Length: 200 mm (A heat transfer oil is circulated through the internal space of the rolls, and the distance between adjacent rolls is 30 mm.)

3. Three cooling rolls Diameter: 250 mm

Length: 200 mm (Cooling water is circulated through the internal space of the rolls.)

4. Nip rolls

Inlet side: A silicone rubber roll having a diameter of 200 mm is disposed so as to be in contact with two preheating rolls.

Outlet side: A silicone rubber roll having a diameter of 200 mm is disposed so as to be in contact with two cooling rolls.

The resulting rolled sheet was slit to a width of 6 mm and then subjected to tensile drawing by means of a drawing apparatus as defined above. The tensile drawing was repeated three times under the conditions shown in Table 1 below.

As a result of the drawing, there was obtained a drawn polyethylene material which was uniformly colored in red.

Measurement of some physical properties of this material revealed that its tensile strength was 25.0 g/d and its elongation was 1.8%.

TABLE 1

| | Roll temperature (°C.) | | Peripheral speed of nip rolls (m/min) | | |
|---|---|---|---|---|---|
| | Preheating rolls | Drawing rolls | Inlet side | Outlet side | Draw ratio |
| Rolling | | | | | 7.0 |
| First pass | 135 | 140 | 1.0 | 3.0 | 3.0 |
| Second pass | 140 | 145 | 3.0 | 7.5 | 2.5 |
| Third pass | 145 | 150 | 7.5 | 11.4 | 1.52 |
| Total | | | | | 79.8 |

(Splitting step)

Specification of splitting apparatus

1. Inlet pinch rolls: A metal roll and a urethane rubber roll, both having a diameter of 160 mm and a length of 200 mm.

2. Outlet pinch rolls: A metal roll and a urethane rubber roll, both having a diameter of 160 mm and a length of 200 mm.

3. Splitter: A tap-like splitting tool having a regular hexagonal cross section with equal sides 20 mm long and a thread pitch of 0.6 mm.

Splitting conditions

1. Nip roll speeds: 30 m/min at the inlet and 30.3 m/min at the outlet.

2. Contact angle and peripheral speed ratio of splitter: 90° and 2.3.

The aforesaid red drawn tape (about 2 mm wide) was split by using the above-defined apparatus and operation conditions. Thus, there was obtained a reticulate split yarn having a rhombic cross section with equal sides 12 mm long and a filament width of 0.6 mm. Measurement of some physical properties of this split yarn [in a state twisted by 100 turns per meter (hereinafter referred to as 100 t/m)] revealed that its tensile strength was 21.0 g/d and its elongation was 1.6%.

EXAMPLE 2

The procedure of Example 1 was repeated except that, in (1) the preparation of a thermoplastic resin film, Cyanine Blue was used in place of Azo Red.

As a result, there was obtained a drawn polyethylene material which was uniformly colored in blue. Its tensile strength was 24.3 g/d and its elongation was 1.8%. This drawn polyethylene material was split to obtain a blue reticulate split yarn having a rhombic cross section. Measurement. of some physical properties of this split yarn (100 t/m) revealed that its tensile strength was 21.0 g/d and its elongation was 1.6%.

EXAMPLE 3

The procedure of Example 1 was repeated except that, in (1) the preparation of a thermoplastic resin film, ultrafine carbon black was used in place of Azo Red.

As a result, there was obtained a drawn polyethylene material which was uniformly colored in black. Its tensile strength was 24.4 g/d and its elongation was 1.8%. This drawn polyethylene material was split to obtain a dark-gray reticulate split yarn having a rhombic cross section. Measurement of some physical properties of this split yarn revealed that its tensile strength was 21.1 g/d and its elongation was 1.6%.

EXAMPLE 4

The procedure of Example 1 was repeated except that, in (1) the preparation of a thermoplastic resin film, 0.5% by weight of stearyldiethanolamine was used in place of Azo Red.

As a result, there was obtained a drawn polyethylene material. Its tensile strength was 25.2 g/d and its elongation was 1.8%. This drawn polyethylene material was split to obtain a reticulate split yarn having a rhombic cross section. Measurement of some physical properties of this split yarn revealed that its tensile strength was 20.9 g/d and its elongation was 1.6%.

When the above drawn material and split yarn were made to come near to scattered ash from above, they attracted no ash even at a distance of several centimeters, indicating that they had satisfactory antistatic properties.

EXAMPLE 5

The procedure of Example 4 was repeated except that 0.5% by weight of fatty acid monoglyceride was used in place of 0.5% by weight of stearyldiethanolamine.

As a result, there was obtained a drawn polyethylene material. Its tensile strength was 24.0 g/d and its elongation was 1.8%. This drawn polyethylene material was split to obtain a reticulate split yarn having a rhombic cross section. Measurement of some physical properties of this split yarn revealed that its tensile strength was 19.8 g/d and its elongation was 1.6%.

When the above drawn material and split yarn were made to come near to scattered ash from above, they attracted no ash even at a distance of several centimeters, indicating that they had satisfactory antistatic properties.

EXAMPLE 6

The procedure of Example 4 was repeated except that 0.1% by weight of HALS (manufactured and sold by Ciba-Geigy under the trade name of Tinuvin 622) was used in place of 0.5% by weight of stearyldiethanolamine.

As a result, there was obtained a drawn polyethylene material. Its tensile strength was 24.0 g/d and its elongation was 1.8%. This drawn polyethylene material was split to obtain a reticulate split yarn having a rhombic cross section. Measurement of some physical properties of this split yarn revealed that its tensile strength was 20.0 g/d and its elongation was 1.6%.

When the above drawn material and split yarn were tested for light stability, they exhibited good performance.

EXAMPLE 7

The procedure of Example 4 was repeated except that 0.1% by weight of HALS (manufactured and sold by Sankyo Co., Ltd. under the trade name of Sanol LS2626) was used in place of 0.5% by weight of stearyldiethanolamine.

As a result, there was obtained a drawn polyethylene material. Its tensile strength was 24.5 g/d and its elongation was 1.8%. This drawn polyethylene material was split to obtain a reticulate split yarn having a rhombic cross section. Measurement of some physical properties of this split yarn revealed that its tensile strength was 20.1 g/d and its elongation was 1.6%.

When the above drawn material and split yarn were tested for light stability, they exhibited good performance.

EXAMPLE 8

(1) Preparation of a thermoplastic resin film

A base, polymer comprising high-density polyethylene (manufactured and sold by Nippon Petrochemicals Co., Ltd. under the trade name of Staflene E-710; M1:1.0) was mixed with 30% by weight of polyvinyl alcohol. This mixture was kneaded at 230° C. and then continuously extruded to form a film having a thickness of 0.02 mm.

(2) Production of a high-strength material

The procedure of Example 1 was repeated except that the above thermoplastic resin film was used.

As a result, there was obtained a drawn polyethylene material. Its tensile strength was 25.0 g/d and its elongation was 1.8%. This drawn polyethylene material was split to obtain a reticulate split yarn having a rhombic cross section. Measurement of some physical properties of this split yarn revealed that its tensile strength was 20.3 g/d and its elongation was 1.6%.

When the hydrophilicity of this drawn material was evaluated by measurement of the contact angle, it exhibited good performance.

EXAMPLE 9

The procedure of Example 8 was repeated except that, in (1) preparation of a thermoplastic resin film, 30% by weight of chtosan was used in place of polyvinyl alcohol.

As a result, there was obtained a drawn polyethylene material. Its tensile strength was 24.0 g/d and its elongation was 1.8%. This drawn polyethylene material was split to obtain a reticulate split yarn having a rhombic cross section. Measurement of some physical properties of this split yarn revealed that its tensile strength was 20.0 g/d and its elongation was 1.6%.

When the hydrophilicity of this drawn material was evaluated by measurement of the contact angle, it exhibited good performance.

EXAMPLE 10

The procedure of Example 8 was repeated except that, in (1) preparation of a thermoplastic resin film, 30% by weight of acrylic acid was used in place of polyvinyl alcohol.

As a result, there was obtained a drawn polyethylene material. Its tensile strength was 24.2 g/d and its elongation was 1.8%. This drawn polyethylene material was split to obtain a reticulate split yarn having a rhombic cross section. Measurement of some physical properties of this split yarn revealed that its tensile strength was 20.1 g/d and its elongation was 1.6%.

When the hydrophilicity of this drawn material was evaluated by measurement of the contact angle, it exhibited good performance.

EXAMPLE 11

(1) Preparation of a thermoplastic resin film

A base polymer comprising high-density polyethylene (manufactured and sold by Nippon Petrochemicals Co., Ltd. under the trade name of Staflene E-710; M1:1.0) was mixed with 15% by weight of Azo Red, and this mixture was processed on a melt extruder to obtain a masterbatch. Then, a mixture of 20 parts by weight of the masterbatch and high-density polyethylene (manufactured and sold by Nippon Petrochemicals Co., Ltd. under the trade name of Staflene E-710; M1:1.0) was kneaded at 230° C. and then continuously extruded to form a film having a thickness of 0.02 mm.

(2) Production of a high-strength material (Extrusion molding)

An ultra-high-molecular-weight polyethylene powder (having an intrinsic viscosity [η] of 14 dl/g as measured in decalin at 135° C. and a viscosity-average molecular weight of 2,000,000) was continuously extruded at 250° C. As a result, there was obtained a sheet having a thickness of 0.1 mm and a width of 90 mm.

(Rolling)

A pair of the aforesaid thermoplatic resin films (about 90 mm wide) having Azo Red incorporated therein were interposed between a pair of rolls (with a diameter of 250 mm, a length of 300 mm and a roll spacing of 0.07 mm) which were disposed above and below, rotated in opposite directions at the same speed, and adjusted to a surface temperature of 140° C. Then, the foregoing compression-molded sheet was fed between the pair of films and rolled at an inlet speed of 1 m/min and an outlet speed of 7 m/min. Thus, there was obtained a colored rolled sheet having a thickness of 0.047 mm (i.e., a reduction ratio of 3) and a width of 88 mm).

(Drawing)

Specifications of drawing apparatus

1. Three preheating rolls Diameter: 250 mm

Length: 200 mm

2. Drawing rolls Diameter: 125 mm

Length: 200 mm (A heat transfer oil is circulated through the internal space of the rolls, and the distance between adjacent rolls is 30 mm.)

3. Three cooling rolls Diameter: 250 mm

Length: 200 mm (Cold water is circulated through the internal space of the rolls.)

4. Nip rolls

Inlet side: A silicone rubber roll having a diameter of 200 mm is disposed so as to be in contact with two preheating rolls.

Outlet side: A silicone rubber roll having a diameter of 200 mm is disposed so as to be in contact with two cooling rolls.

The resulting rolled sheet was slit to a width of 12 mm and then subjected to tensile drawing by means of a drawing apparatus as defined above. The tensile drawing was repeated three times under the conditions shown in Table 2 below.

As a result of the drawing, there was obtained a drawn polyethylene material (2.8 mm wide and 0.02 mm thick) which was uniformly colored in red.

Measurement of some physical properties of this material revealed that its tensile strength was 19 g/d and its elongation was 1.8%.

TABLE 2

| | Roll temperature (°C.) | | Peripheral speed of nip rolls (m/min) | | |
|---|---|---|---|---|---|
| | Preheating rolls | Drawing rolls | Inlet side | Outlet side | Draw ratio |
| Rolling | | | | | 3.0 |
| First pass | 135 | 140 | 1.0 | 3.0 | 3.0 |
| Second pass | 140 | 145 | 3.0 | 6.0 | 2.0 |
| Third pass | 145 | 150 | 7.5 | 9.0 | 1.5 |
| Total | | | | | 27.0 |

(Splitting step)

Specification of splitting apparatus

1. Inlet pinch rolls: A metal roll and a urethane rubber roll, both having a diameter of 160 mm and a length of 200 mm.

2. Outlet pinch rolls: A metal roll and a urethane rubber roll, both having a diameter of 160 mm and a length of 200 mm.

3. Splitter: A tap-like splitting tool having a regular hexagonal cross section with equal sides 20 mm long and a thread pitch of 0.6 mm.

Splitting conditions

1. Nip roll speeds: 30 m/min at the inlet and 30.3 m/min at the outlet.

2. Contact angle and peripheral speed ratio of splitter: 90° and 2.3.

The aforesaid red drawn tape (about 2.8 mm wide) was split by using the above-defined apparatus and operation conditions. Thus, there was obtained a reticulate split yarn having a rhombic cross section with equal sides 12 mm long and a filament width of 0.6 mm. Measurement of some physical properties of this split yarn [in a state twisted by 100 turns per meter (100 t/m)] revealed that its tensile strength was 17 g/d and its elongation was 1.6%.

What is claimed is:

1. A method for the continuous production of a polyethylene material having high strength and high modulus of elasticity comprising:

rolling an ultra-high-molecular-weight polyethylene film said polyethylene having an intrinsic viscosity of 5 to 20 dl/g as measured in decalin at 135° C. with at least one thermoplastic resin film said thermoplastic resin having incorporated therein at least one additive selected from the group consisting of a coloring agent, a weathering stabilizer, an antistatic agent, a hydrophilicity-imparting agent, an adhesion promoter and a dyeability-imparting agent, and drawing the rolled material, wherein said thermoplastic resin film is dispersed in the interior and/or surface of said ultra-high-molecular weight polyethylene film.

2. A method as claimed in claim 1 wherein the ultra-high-molecular-weight polyethylene film is one obtained by a process selected from the group consisting of a process forming an ultra-high-molecular-weight polyethylene powder into a film in a solid phase, a process of melting an ultra-high-molecular weight polyethylene and forming the molten material into a film, and a process of dissolving an ultra-high-molecular-weight polyethylene and forming a gel film from the solution.

3. A method as claimed in claim 2 wherein the process of forming an ultra-high-molecular-weight polyethylene powder into a film in a solid phase is a compression molding process.

4. A method as claimed in claim 1 wherein the thermoplastic resin layer is formed from one or more thermoplastic resins selected from the group consisting of an olefin polymer, a polyamide polymer, a polyester polymer and a polyvinyl chloride polymer.

5. A method as claimed in claim 4 wherein the olefin polymer is a polymer selected from the group consisting of (1) an ethylene (co)polymer including an ethylene polymer and an ethylene-α-olefin copolymer which are prepared by means of a Ziegler catalyst, an ethylene polymer and a copolymers which are prepared by high-pressure radical polymerization, and mixtures thereof, and (2) a modified ethylene (co)polymer obtained by subjecting said ethylene polymer and ethylene-α-olefin copolymer which are prepared by means of Ziegler catalyst, ethylene polymer and copolymer which are prepared by high-pressure radical polymerization and mixtures thereof, to graft reaction in the presence of an unsaturated carboxylic acid and/or a derivative thereof, and an organic peroxide.

6. A method as claimed in claim 5 wherein the olefin polymer has an intrinsic viscosity of 0.5 to 3 dl/g.

7. A method as claimed in claim 1 wherein the coloring agent is an organic pigment or an inorganic pigment.

8. A method as claimed in claim 1 wherein the weathering stabilizer is selected from the group consisting of radical chain stoppers, peroxide decomposers and ultraviolet light absorbers.

9. A method as claimed in claim 1 wherein the antistatic agent comprises one or more members selected from the group consisting of nonionic, anionic, cationic and amphoteric surface-active agents.

10. A method as claimed in claim 1 wherein the adhesion promoter is selected from the group consisting of uncured epoxy resins, uncured unsaturated polyesters and modified polyamides.

11. A method as claimed in claim 1 wherein the amount of additive incorporated in the thermoplastic resin layer is in the range of 0.05 to 40% by weight based on the thermoplastic resin.

12. A method as claimed in claim 1 wherein the amount of additive incorporated in the thermoplastic resin layer is in the range of 0.5 to 30% by weight.

13. A method as claimed in claim 12 wherein the amount of weathering stabilizer incorporated in the thermoplastic resin layer is in the range of 0.01 to 10% by weight.

14. A method as claimed in claim 12 wherein the amount of antistatic agent incorporated in the thermoplastic resin layer is in the range of 0.01 to 10% by weight.

15. A method as claimed in claim 12 wherein the amount of hydrophilicity-imparting agent incorporated in the thermoplastic resin layer is in the range of 1 to 20% by weight.

16. A method as claimed in claim 12 wherein the amount of adhesion promoter incorporated in the thermoplastic resin layer is in the range of 1 to 20% by weight.

17. A method as claimed in claim 12 wherein the amount of dyeability-imparting agent incorporated in the thermoplastic resin layer is in the range of 1 to 20% by weight.

18. A method as claimed in claim 1 wherein the thickness ratio between the film material to be rolled and the thermoplastic resin layer is in the range of 60/40 to 98/2.

19. A method as claimed in claim 1 wherein a thermoplastic resin film is dispersed in the one or either surfaces of the ultra-high-molecular-weight polyethylene film.

20. A method as claimed in claim 19, wherein a thermoplastic resin film is laminated to one or either surface of the rolled material in the drawing step.

21. A method as claimed in claim 1 wherein the lamination is carried out at a temperature in the range of 90° to 140° C. and a pressure in the range of 0.1 to 200 kg/cm$^2$.

22. A method as claimed in claim 1 wherein the rolling efficiency (the ratio of the length after rolling to the length before rolling) in the rolling step is in the range of 1.2 to 20.

23. A method as claimed in claim 1 wherein, the rolled material is drawn at a temperature in the range of 60° to 160° C. and a drawing speed in the range of 1 mm/min to 500 m/min.

24. A method as claimed in claim 23 wherein the drawn material is split to obtain a split yarn having a thickness in the range of 10 to 200 μm and a split width in the range of 10 to 500 μm.

25. A method as claimed in claim 24 wherein the split yarn is twisted by 50 to 500 turns per meter to obtain a twisted yarn having a high strength of 8 g/d or greater.

* * * * *

UNITED STATES PATENT AND TRADEMARK OFFICE

CERTIFICATE OF CORRECTION

PATENT NO. : 5,702,657

DATED : December 30, 1997

INVENTOR(S) : Sumio YOSHIDA, et al.

It is certified that error appears in the above-indentified patent and that said Letters Patent is hereby corrected as shown below:

On the title page, in Item[75], the fourth inventor's residence should read:

--Tokyo--

Signed and Sealed this

Twenty-first Day of April, 1998

Bruce Lehman

*Attest:*

BRUCE LEHMAN

*Attesting Officer*

*Commissioner of Patents and Trademarks*